US007984680B1

(12) United States Patent
Tsai et al.

(10) Patent No.: US 7,984,680 B1
(45) Date of Patent: Jul. 26, 2011

(54) KNOCKDOWN SHELF STRUCTURE

(75) Inventors: Li-Chun Tsai, Xizhi (TW); Huei-Ling Liao, Xizhi (TW)

(73) Assignee: Everglide Caster Corp., Taipei (TW)

( * ) Notice: Subject to any disclaimer, the term of this patent is extended or adjusted under 35 U.S.C. 154(b) by 0 days.

(21) Appl. No.: 12/829,402

(22) Filed: Jul. 2, 2010

(51) Int. Cl.
*A47B 91/00* (2006.01)

(52) U.S. Cl. ..... 108/186; 108/53.5; 108/64; 108/190; 211/188

(58) Field of Classification Search ..... 108/64, 108/107, 180, 190, 192, 91, 101, 186, 147.12, 108/147.13, 53.5; 211/108, 186, 189, 191, 211/194, 134; 206/503, 511, 512, 599, 600
See application file for complete search history.

(56) References Cited

U.S. PATENT DOCUMENTS

| | | | | | |
|---|---|---|---|---|---|
| 747,683 | A * | 12/1903 | Clarke | 403/321 |
| 923,721 | A * | 6/1909 | Smith | 108/92 |
| 3,294,250 | A * | 12/1966 | Evans | 211/190 |
| 3,360,180 | A * | 12/1967 | Venturi | 220/7 |
| 3,367,291 | A * | 2/1968 | Evans | 108/64 |
| 3,784,021 | A * | 1/1974 | Mark | 211/43 |
| 4,463,997 | A * | 8/1984 | Densen | 312/259 |
| 4,665,836 | A * | 5/1987 | Burr | 108/64 |
| 5,158,187 | A * | 10/1992 | Taub | 211/186 |
| 5,492,069 | A * | 2/1996 | Alexander et al. | 108/56.3 |
| 5,881,653 | A * | 3/1999 | Pfister | 108/147.13 |
| 5,887,529 | A * | 3/1999 | John et al. | 108/56.1 |
| 6,047,648 | A * | 4/2000 | Alm et al. | 108/157.16 |
| 6,062,150 | A * | 5/2000 | Sikora et al. | 108/190 |
| 7,832,584 | B2 * | 11/2010 | Eggers et al. | 220/7 |

FOREIGN PATENT DOCUMENTS

EP 195527 A1 * 9/1986

* cited by examiner

*Primary Examiner* — Darnell M Jayne
*Assistant Examiner* — Kimberley S Wright
(74) *Attorney, Agent, or Firm* — Leong C. Lei

(57) ABSTRACT

A knockdown shelf structure includes multiple unit board members, each of which forms first jointing portions and second jointing portions, wherein each first jointing portions is engageable with a corresponding one of the second jointing portions of another unit board member so as to joint and securely couple these two unit board members to form a large span of support board by jointing a large number of unit board members together and wherein each unit board member has a bottom forming third jointing portions; and multiple elevating members, each of which has a top rim structured to be jointable to each of the third jointing portions of the unit board member so as to elevate the unit board member upward, whereby a shelf structure for supporting articles thereon is formed by assembling the unit board members and the elevating members together.

2 Claims, 8 Drawing Sheets

KNOCKDOWN SHELF STRUCTURE

TECHNICAL FIELD OF THE INVENTION

The present invention generally relates to a knockdown shelf structure, and more particularly to a shelf structure that can be assembled as a single-leveled or multi-leveled shelf as desired.

DESCRIPTION OF THE PRIOR ART

To organize and store articles, a storage shelf or cabinet is used to receive/support the articles thereon. The shelf structure can be multi-leveled to store articles in a vertically arranged manner for full use of a limited space.

Most of the shelf structures that are currently available are fixed, meaning the shelf structure cannot be modified, where the storage space of a shelf structure that is not occupied by articles becomes a waste. This makes the shelf itself a waste of space. Further, such a fixed shelf structure cannot be expanded once the amount of articles to be stored exceeds the capacity of the shelf structure, so that the fixed shelf structure is generally not very practical for use.

Knockdown shelf structures are available, which are formed by jointing a single layer or multiple layers of shelf together. However, these known knockdown shelf structures are of no sound structure for the connection between components thereof is not secured, so that the gravity center of a loaded shelf may get sideways, making the shelf tipping over.

In view of such a problem, the present invention aims to provide a knockdown shelf structure that overcomes the problem.

SUMMARY OF THE INVENTION

The primary objective of the present invention is to provide a knockdown shelf structure, which comprises at least a plurality of unit board members, each of which forms a plurality of first jointing portions and second jointing portions, wherein each of the first jointing portions is engageable with a corresponding one of the second jointing portions of another unit board member so as to joint and securely couple these two adjacent unit board members to thereby form a large span of support board by jointing a large number of these unit board members together and wherein each of the unit board members has a bottom on which a plurality of third jointing portions is formed; and a plurality of elevating members, each of which has a top rim structured to be jointable to each of the third jointing portions of the unit board member so as to elevate the unit board member upward, whereby a shelf structure having a single level of shelf for supporting articles thereon is formed by assembling the plurality of unit board members and elevating members together.

The first jointing portion of the unit board member is structured to project downward from the bottom of the unit board member and comprises a web section and a flange section that extends sideways from a lower end of the web section in a single direction or in opposite directions to form an L-shape or an inverted T-shape. The second jointing portion comprises a retention slot, which has an end that is expanded to form an expanded receiving opening, whereby the flange section of a corresponding first jointing portion of another unit board member is allowed to enter and pass through the expanded receiving opening and the web section of the first jointing portion of said another unit board member is set in alignment with the retention slot of the second jointing portion to allow for a relative sliding motion to be taken between the two unit board members by a predetermined distance for having the web section of the first jointing portion of one of the unit board members sliding into the retention slot of the second jointing portion of the other one of unit board members with the flange section of the first jointing portion engaging lower surface of the retention slot to securely couple the two unit board members together.

According to the present invention, each third jointing portion of the unit board member comprises two opposite pawls, which engage and grip a top rim of a corresponding one of the elevating members. The bottom of the unit board member is recessed in such a way to form a recessed cavity, which closely receives the top rim of an elevating member therein.

According to the present invention, each of the unit board members forms a plurality of fitting holes. The shelf structure may additionally comprise a coupling collar, which is selectively fit into and received in each fitting hole of the unit board member; and an erection bar, which has a lower end closely fit into the coupling collar and an upper end connectable to a bottom portion of a coupling member, the coupling member having a top portion that forms a coupling bore for closely receiving and thus jointing an elevating member of an upper level of support board constructed with a plurality of unit board members according to the present invention, whereby the present invention provides an alternative form of knockdown shelf structure that is formed by vertically stacking and connecting a number of levels of support boards each of which is constructed with a plurality of unit board members for supporting articles thereon.

According to the present invention, the elevating member is mounted, in a vertical direction, to the lower side of the fitting hole of the unit board member and the top of the elevating member is recessed to form a jointing cavity for receiving and retaining the coupling collar therein.

The present invention provides a shelf structure that is formed as a single-level shelf structure by jointing a plurality of unit board members together to form a planar support board according to the need of a user and mounting a plurality of elevating members under the support board to separate any articles positioned on the support board from the ground. Alternatively; a plurality of coupling collars and erection bars are additionally provided for vertically coupling between multiple support boards, each of which is formed by jointing a plurality of unit board members so as to form a multi-level shelf structure to suit the need of a user for storing articles. Thus, the present invention provides the following advantages, which issue the present invention novelty and industrial use.

(1) All the constituent components of the shelf structure according to the present invention can be detached and reassembled as desired, so that the shelf structure occupies less space and is light in weight and can be used as a pallet or an article storage shelf.

(2) The erection bars vertically supporting between support boards can be made to have a length desired by a user.

(3) The present invention provides a shelf structure that is of multiple levels and results of tests carried out on such a multi-leveled shelf structure shows the first level can take a load of 500-1,000 Kgs, the second level 300-500 Kgs, and the third level 300 Kgs. These levels are separated by erection bars so that they do not contact and depress each other. This protects the articles stored thereon from damage caused by stacking.

(4) The shelf structure of the present invention facilitates shipping and packaging.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

Figure 1:
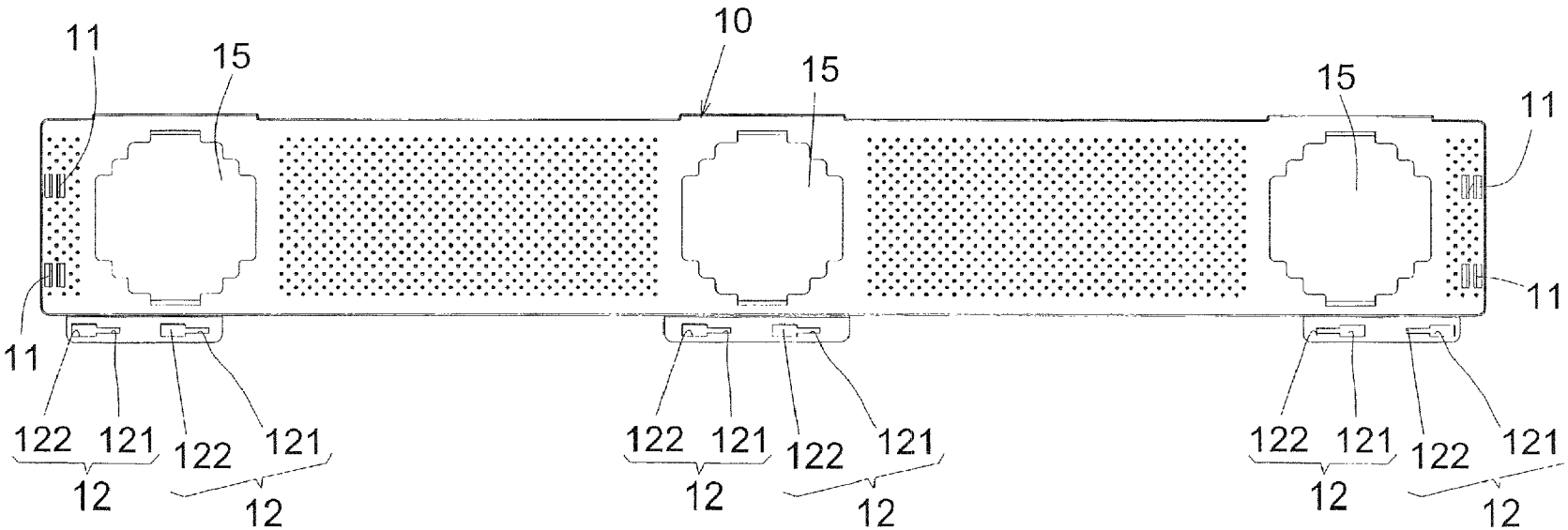
FIG. 1 is a top plan view of a unit board member according to the present invention.

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Referring to FIGS. 1-6, the present invention provides a knockdown shelf structure, which comprises at least a plurality of unit board members 10, each of which forms a plurality of first jointing portions 11 and second jointing portions 12, wherein each of the first jointing portions 11 is engageable with a corresponding one of the second jointing portions 12 of another unit board member 10 so as to joint and securely couple these two unit board members 10, which are set adjacent to each other, to thereby form a large span of a support board 100 by jointing a large number of these unit board members 10 together and wherein each of the unit board members 10 has a bottom on which a plurality of third jointing portions 13 is formed; and a plurality of elevating members 20, each of which has a top rim structured to be jointable to each of the third jointing portions 13 of the unit board member 10 so as to elevate the unit board member 10 upward, whereby a shelf structure having a single level of shelf for supporting articles thereon is formed by assembling the plurality of unit board members 10 and elevating members 20 together.

As shown in FIGS. 1-4, the first jointing portion 11 of the unit board member 10 is structured to project downward from the bottom of the unit board member 10 and comprises a web section 111 and a flange section 112 that extends sideways from a lower end of the web section 111 in a single direction or in opposite directions to form an L-shape or an inverted T-shape. The second jointing portion 12 comprises a retention slot 121, which has an end that is expanded to form an expanded receiving opening 122, whereby the flange section 112 of a corresponding first jointing portion 11 of another unit board member 10 is allowed to enter and pass through the expanded receiving opening 122 and the web section 111 of the first jointing portion 11 of said another unit board member 10 is set in alignment with the retention slot 121 of the second jointing portion 12 to allow for a relative sliding motion to be taken between the two unit board members 10 by a predetermined distance for having the web section 111 of the first jointing portion 11 of one of the unit board members 10 sliding into the retention slot 121 of the second jointing portion 12 of the other one of unit board members 10 with the flange section 112 of the first jointing portion 11 engaging lower surface of the retention slot 121 to securely couple the two unit board members 10 together.

Figure 2:
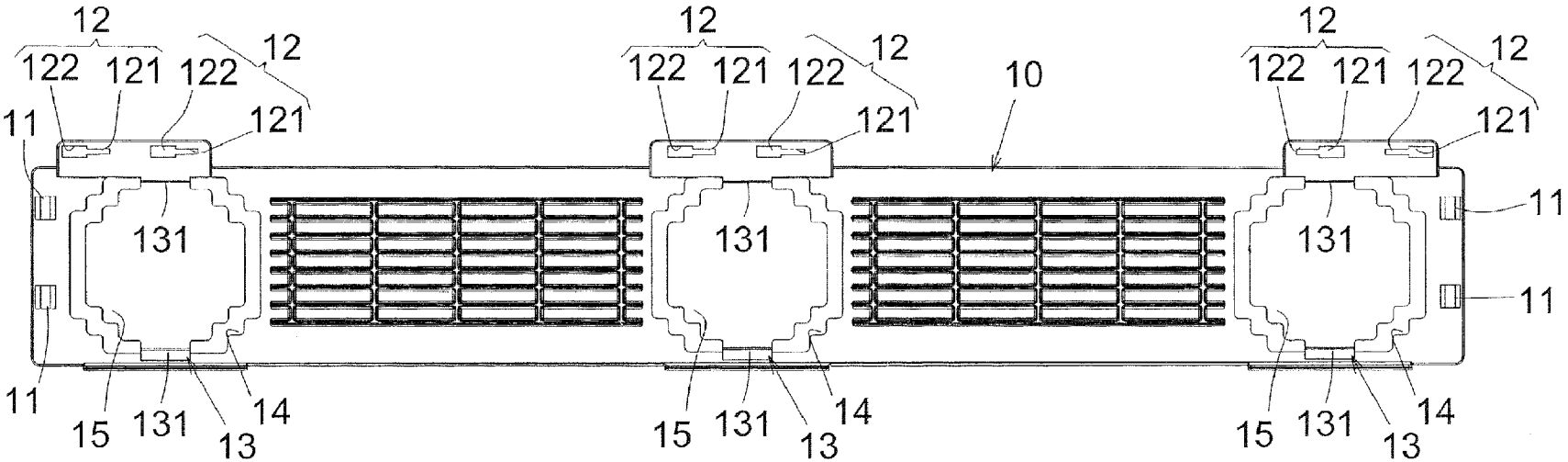
FIG. 2 is a bottom plan view of the unit board member according to the present invention.
Figure 3:
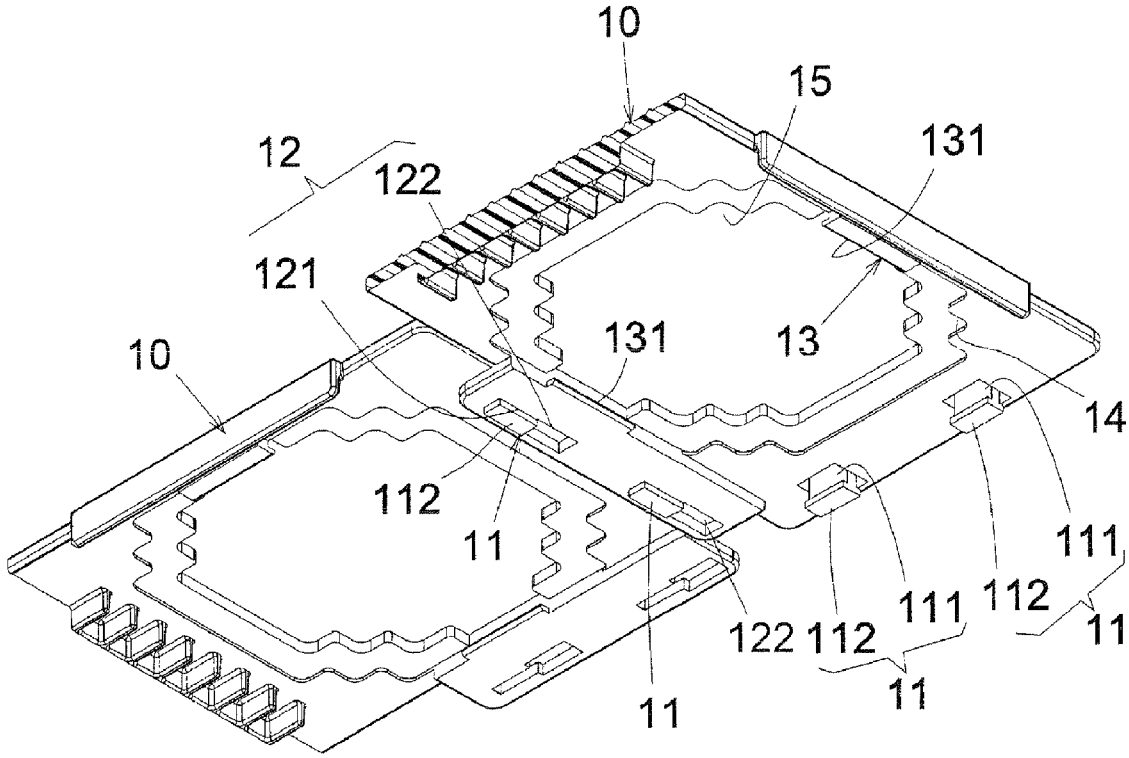
FIG. 3 is a perspective view, taken from the bottom side, showing two unit board members jointed to each other.
Figure 4:
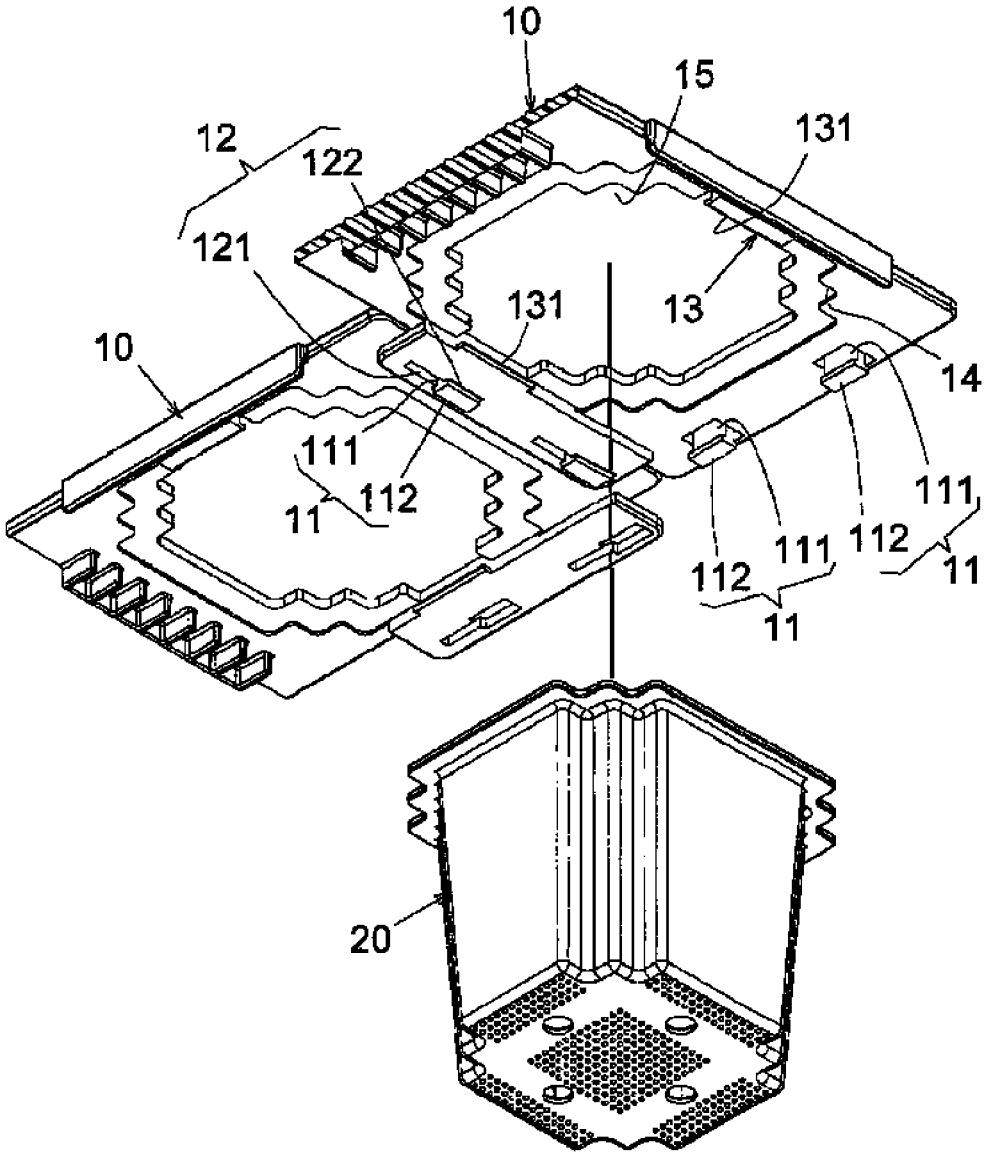
FIG. 4 is a perspective view, taken from the bottom side, showing a first jointing portion of one unit board member received in a second jointing portion of another unit board member, and also showing an elevating member to be jointed to the unit board members.
Figure 5:
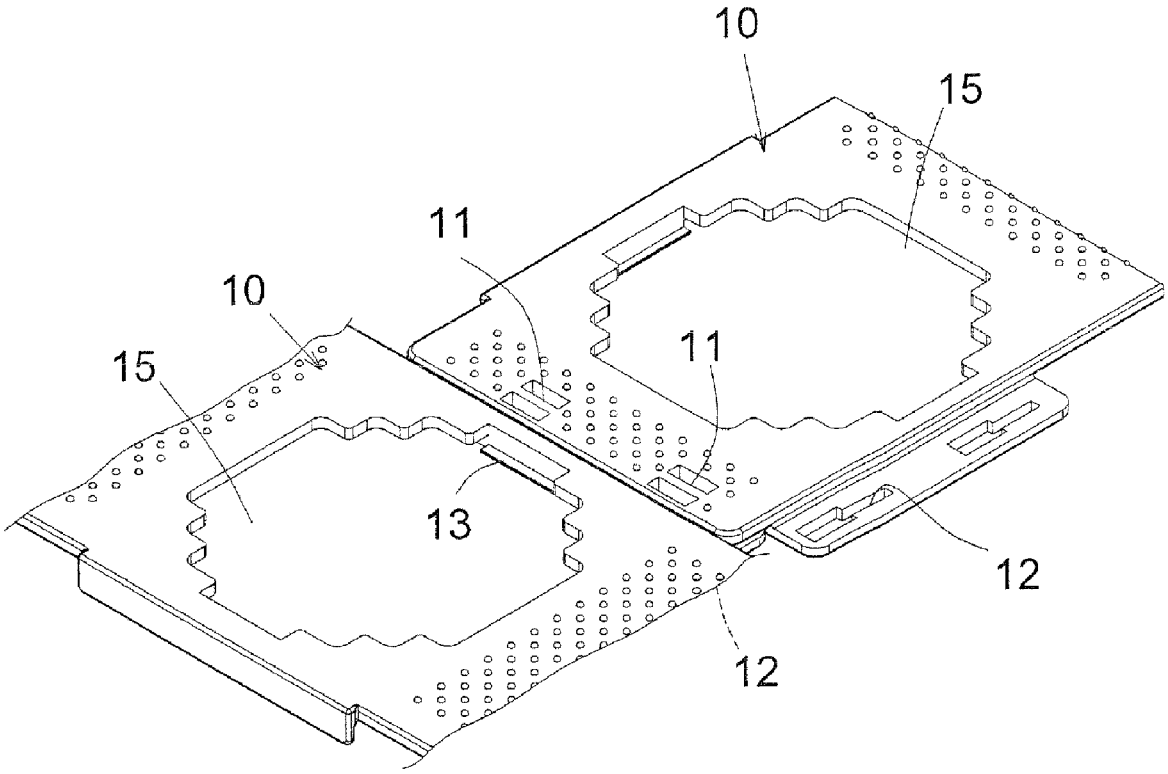
FIG. 5 is a perspective view, taken from the top side, showing two unit board members jointed to each through a relative sliding motion therebetween from the condition shown in FIG. 4.
Figure 6:
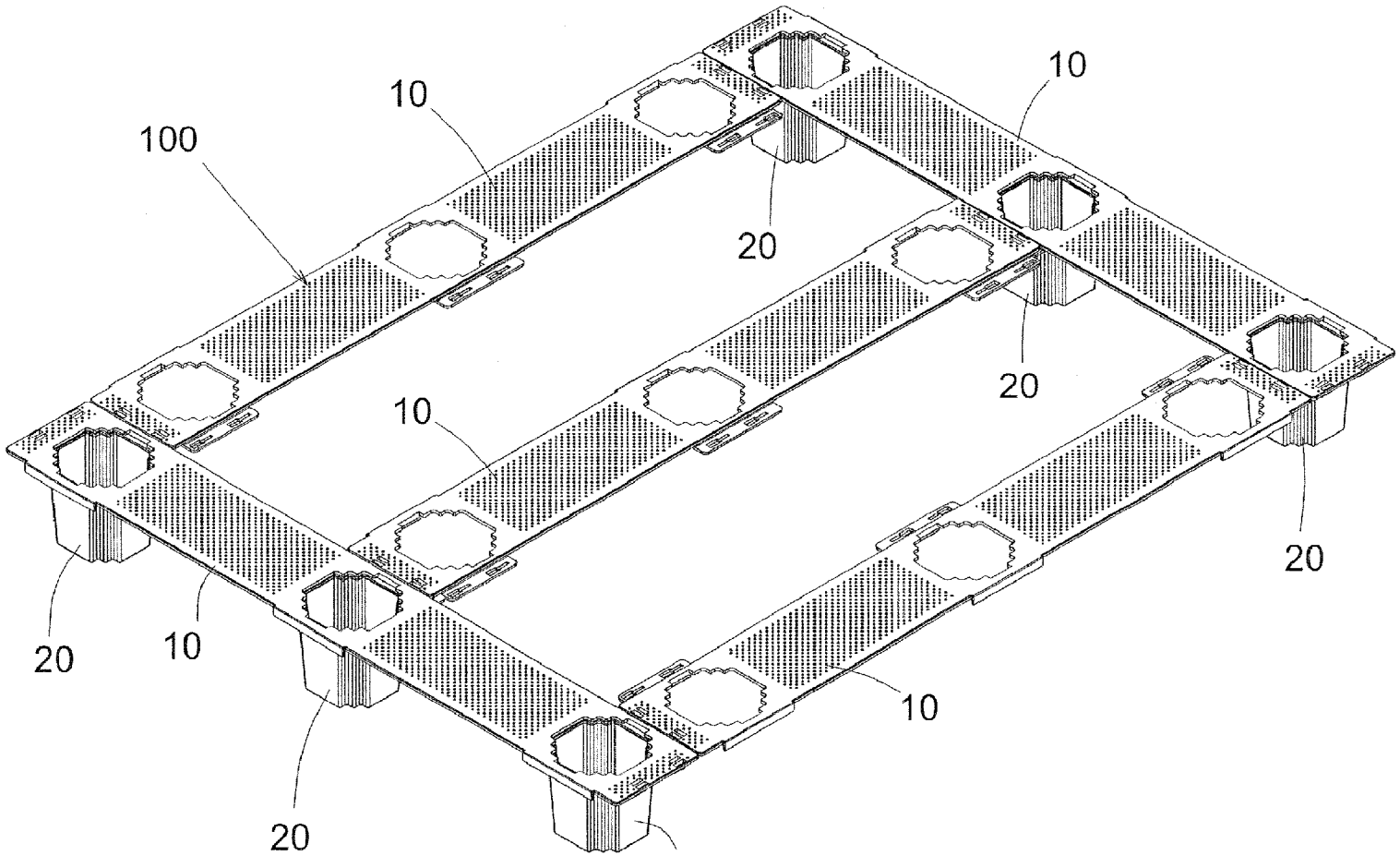
FIG. 6 is a perspective view showing a single-level shelf structure according to an embodiment of the present invention.

As shown in FIGS. 2 and 3, each third jointing portion 13 of the unit board member 10 comprises two opposite pawls 131, which engage and grip a top rim of a corresponding one of the elevating members 20. According to the present invention, the bottom of the unit board member 10 is recessed in such a way to form a recessed cavity 14, which closely receives the top rim of an elevating member 20 therein.

Figure 7:
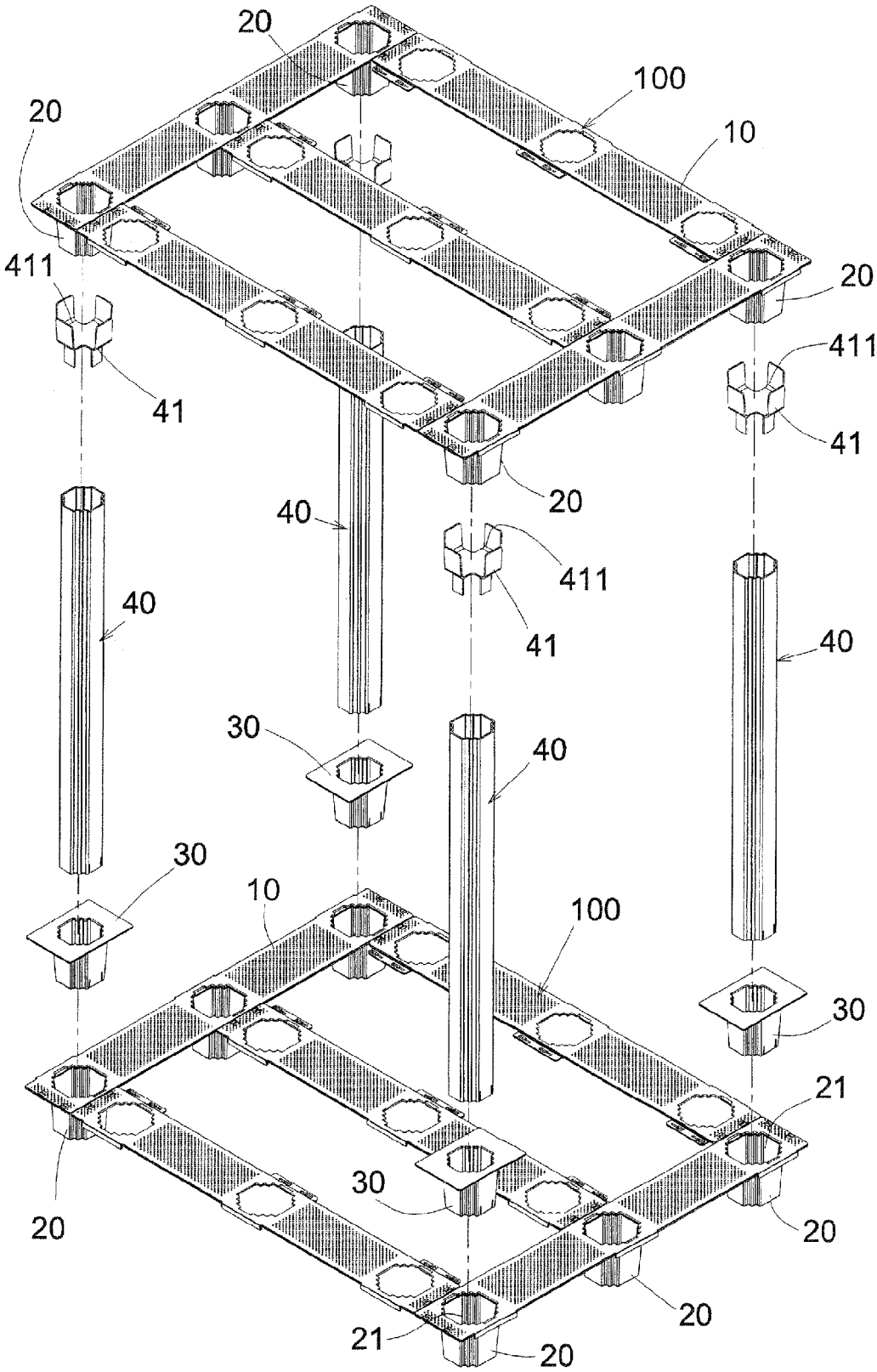
FIG. 7 is an exploded view showing the assembling of a multi-leveled shelf structure according to another embodiment of the present invention.
Figure 8:
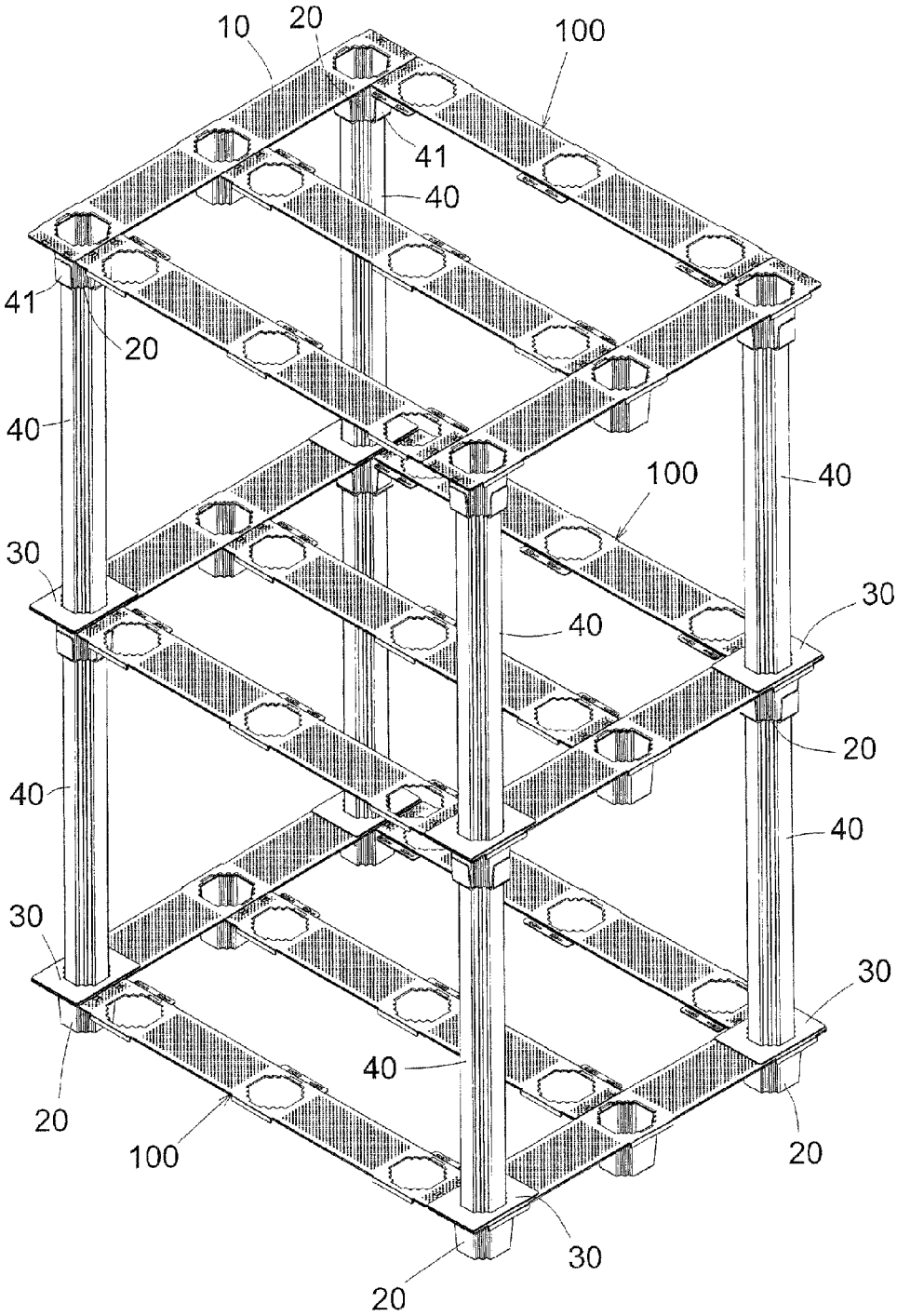
FIG. 8 is a perspective view of a multi-leveled shelf structure according to the present invention in an assembled form.

As shown in FIGS. 7 and 8, each of the unit board members 10 forms a plurality of fitting holes 15. According to another feature of the present invention, the shelf structure selectively further comprises a coupling collar 30, which is selectively fit into and received in each fitting hole 15 of the unit board member 10; and an erection bar 40, which has a lower end closely fit into the coupling collar 30 and an upper end connectable to a bottom portion of a coupling member 41, the coupling member 41 having a top portion that forms a coupling bore 411 for closely receiving and thus jointing an elevating member 20 of an upper level of support board 100 constructed with a plurality of unit board members 10 according to the present invention, whereby the present invention provides an alternative form of knockdown shelf structure that is formed by vertically stacking and connecting a number of levels of support boards 100 each of which is constructed with a plurality of unit board members 10 for supporting articles thereon.

In an alternative embodiment, the erection bar 40 and the coupling member 41 can be integrally formed together as a unitary member, but the present invention is not limited to any of these. The elevating member 20 is mounted, in a vertical direction, to the lower side of the fitting hole 15 of the unit board member 10 and the top of the elevating member 20 is recessed to form a jointing cavity 21 for receiving and retaining the coupling collar 30 therein.

The present invention provides a shelf structure that is formed as a single-level shelf structure by jointing a plurality of unit board members 10 together to form a planar support board 100 according to the need of a user and mounting a plurality of elevating members 20 under the support board to separate any articles positioned on the support board from the ground; alternatively, a plurality of coupling collars 30 and erection bars 40 are additionally provided for vertically coupling between multiple support boards 100, each of which is formed by jointing a plurality of unit board members 10 and elevating members 20 so as to form a multi-level shelf structure.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

We claim:

1. A shelf structure comprising:

a plurality of elongated unit board members each having two long sides and two short sides, each of the short sides having a first jointing portion, one of the long sides having a second jointing portion, the first jointing portion being engageable with a corresponding second jointing portion of another elongated unit board member so as to joint and securely couple the two elongated unit board members to thereby form a large span of support board by jointing the plurality of elongated unit board members together, each of the elongated unit board members having a bottom on which a plurality of third jointing portions is formed, the first jointing portion of each of the elongated unit board members being structured to project downward from the bottom of the elongated unit board members and comprising a web section and a flange section extending sideways from a lower end of the web section, the second jointing portion comprising a retention slot which has an end that is expanded to form an expanded receiving opening whereby the flange section of the first jointing portion of another elongated unit board member is allowed to enter and pass through the expanded receiving opening and a relative sliding motion is allowed between the two elongated unit board members by a predetermined distance for having the web section of the first jointing portion of one of the elongated unit board members sliding into the retention slot of the second jointing portion of the other one of elongated unit board members with the flange section of the first jointing portion engaging lower surface of the retention slot, each of the third jointing portions comprising two opposite pawls, each of the elongated unit board members having a bottom that is recessed to form a recessed cavity, each of the elongated unit board members having a plurality of fitting holes; and a plurality of elevating members each having a top rim structured to be engageable with the two opposite pawls of the third jointing portions so as to elevate the elongated unit board member upward, the top rim of the elevating members being closely received in the recessed cavity of the elongated unit board members;

a coupling collar selectively fit into and received in each of the fitting holes of the elongated unit board member;

an erection bar having a lower end fit into the coupling collar; and a coupling member having a bottom portion connectable to an upper end of the erection bar, the coupling member having a top portion that forms a coupling bore for receiving and thus jointing an elevating member of an upper level of support board formed of a plurality of elongated unit board members;

wherein the elevating member is mounted, in a vertical direction, to a lower side of the fitting hole of the elongated unit board members and a top of the elevating member is recessed to form a jointing cavity for receiving and retaining the coupling collar therein.

2. The shelf structure according to claim 1, wherein the erection bar and the coupling member are integrally formed as a unitary member.

* * * * *